US008391515B2

(12) United States Patent
Lu et al.

(10) Patent No.: US 8,391,515 B2
(45) Date of Patent: Mar. 5, 2013

(54) MICRO-SPEAKER

(75) Inventors: Ji-Liang Lu, Shenzhen (CN); Wen-Tao Jiang, Shenzhen (CN)

(73) Assignees: AAC Acoustic Technologies (Shenzhen) Co., Ltd., Shenzhen (CN); AAC Technologies Pte. Ltd., Singapore (SG)

( * ) Notice: Subject to any disclaimer, the term of this patent is extended or adjusted under 35 U.S.C. 154(b) by 201 days.

(21) Appl. No.: 12/978,611

(22) Filed: Dec. 26, 2010

(65) Prior Publication Data

US 2011/0235850 A1 Sep. 29, 2011

(30) Foreign Application Priority Data

Mar. 29, 2010 (CN) ..... 2010 2 0148404 U

(51) Int. Cl.
*H04R 25/00* (2006.01)
*H04R 1/02* (2006.01)
*H04R 1/00* (2006.01)

(52) U.S. Cl. ..... 381/150; 381/386; 381/410

(58) Field of Classification Search ..... 381/433, 381/409, 410, 396, 388, 370; 29/594
See application file for complete search history.

(56) References Cited

U.S. PATENT DOCUMENTS

| | | | | |
|---|---|---|---|---|
| 5,953,437 | A * | 9/1999 | Imahori et al. | 381/417 |
| 2005/0111194 | A1* | 5/2005 | Sohn | 361/704 |
| 2007/0116321 | A1* | 5/2007 | Jang et al. | 381/388 |

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

A speaker includes a case, a dome, a diaphragm, a first voice coil, a second voice coil, a first pole plate, a second pole plate, a first magnet, a second magnet and a yoke. The case is supported on the frame to form a receiving room therebetween. The yoke includes a bottom portion and a side portion perpendicularly extending upward from the center of the bottom portion. A first magnetic gap is formed between the inner wall of the side portion and the outer wall of the magnet for receiving the first voice coil, and a second magnetic gap is formed between the outer wall of the side portion and the inner wall of the second magnet for receiving the second voice coil.

10 Claims, 3 Drawing Sheets

MICRO-SPEAKER

BACKGROUND OF THE INVENTION

1. Technical Field

The present disclosure relates to the art of speakers and, particularly to a micro-speaker used in an electronic device which is improved the sound output quality thereof and is prevented from being adversely affected due to static electricity.

2. Description of Related Art

With the continuing development of audio and sound technology, micro-speakers have been widely used in electronic devices, such as mobile phones, PDAs (personal digital assistants), and so on.

A conventional micro-speaker includes a case defining a sound hole, a frame attached to the case for forming a chamber therebetween, a diaphragm located in the chamber, a voice coil attached to the diaphragm, a magnet and a circuit board electrically connected to the voice coil. When an oscillating electric current is supplied to the voice coil from the circuit board, a corresponding oscillating magnetic field is generated by the voice coil. The oscillating magnetic field is superimposed onto a magnetostatic field generated by the magnet. This compels the voice coil to vibrate, and the oscillating voice coil drives the diaphragm to push ambient air to generate sound. Furthermore, when a suddenly shaken is supplied to an electronic device embedded with the micro-speaker, this compels the diaphragm to vibrate, thereby the voice coil is driven to oscillate in the magnetostatic field to generate a static electricity. However, in the above process, static electricity is easily generated due to friction between the diaphragm and the ambient air, or the voice coil oscillating in the magnetic field generated by the magnet. The static electricity and the oscillating electric current in the voice coil interfere with each other. Thus, the sound output quality of the micro-speaker may be adversely affected. Even worse, the static electricity may burn out the circuit board and the voice coil electrically with the circuit board.

Therefore, it is desirable to provide a micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
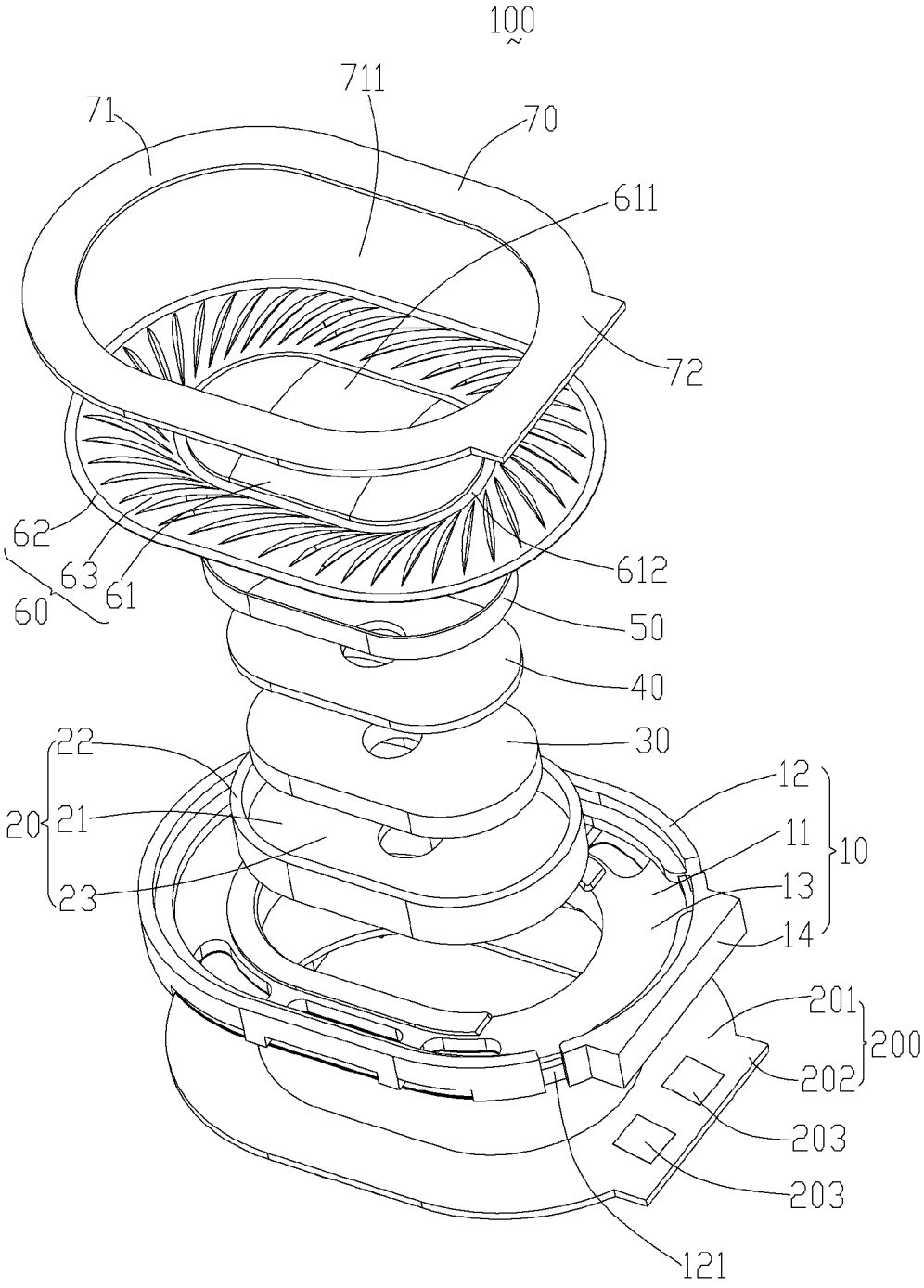
FIG. 1 is exploded, isometric view of the micro-speaker according to an exemplary embodiment.
Figure 2:
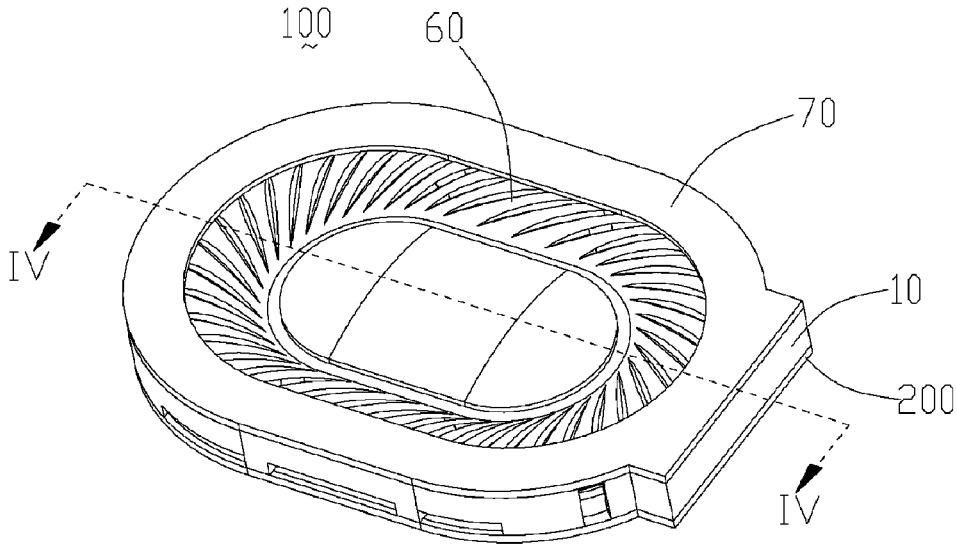
FIG. 2 is an assembled view of the micro-speaker of FIG. 1.
Figure 3:
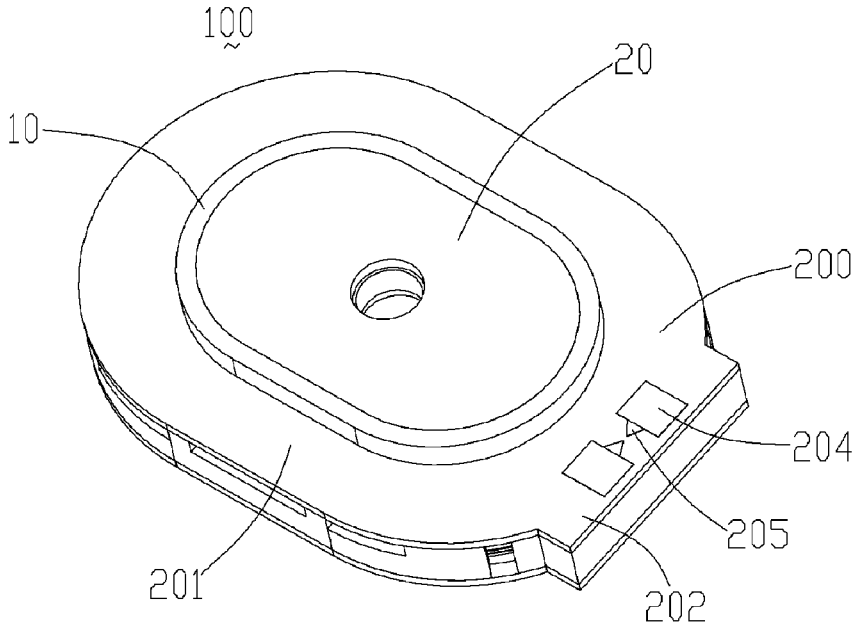
FIG. 3 is similar to FIG. 2, but showing the micro-speaker inverted.
Figure 4:
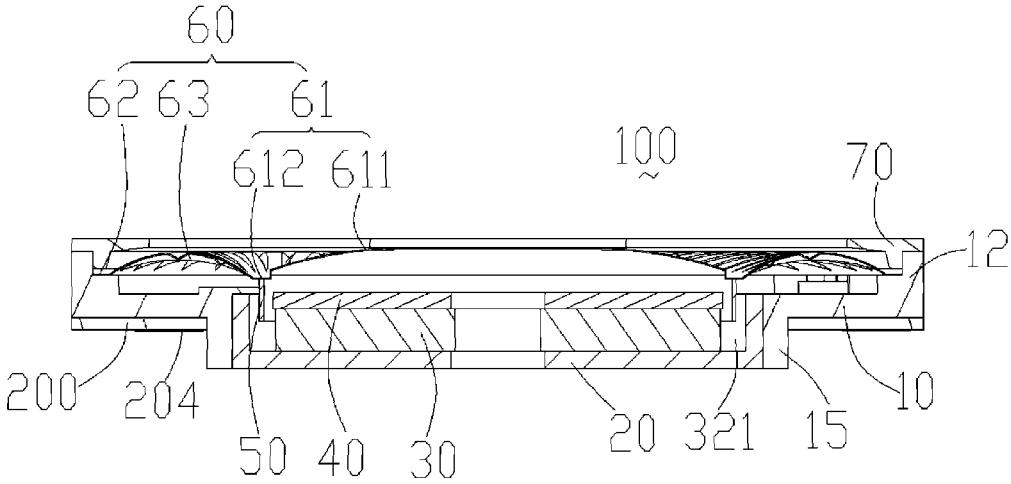
FIG. 4 is a cross-sectional view of the micro-speaker taken along line IV-IV of FIG. 2.

Referring to FIGS. 1-4, especially to FIGS. 1 and 4, a micro-speaker 100, according to an exemplary embodiment, includes a frame 10, a yoke 20 engaged with the frame 10, a magnet 30 received in the yoke 20, a pole plate 40 attached on the magnet 30, a voice coil 50 surrounding the magnet 30 and the pole plate 40, a diaphragm 60 attached to the frame 10, a case 70 covering the diaphragm 60, and a printed circuit board (PCB) 200 engaged with the frame 10. The frame 10 cooperatively with the case 70 defines a chamber (not labeled) therebetween for receiving the yoke 20, the magnet 30, the pole plate 40, the voice coil 50 and the diaphragm 60 therein.

The frame 10 is approximately oblong bowl-shaped, and includes a base plate 11, an upper side plate 12 extending upwardly and perpendicularly from an outer periphery of the base plate 11, a flange 14 extending outwardly from an outer side of the upper side plate 12, and a low side plate 15 (referring to FIG. 4) extending downwardly and perpendicularly from a bottom portion of the base plate 11. The base and side plates 11, 12, 15 cooperatively define a receiving space 13 therebetween. The base plate 11 is elliptical, and the yoke 20 is located at a center of the base plate 11. The upper side plate 12 defines a pair of through slots 121 spanning an entire height thereof and formed adjacent to the flange 14. Therefore, two opposite terminals (not shown) of the voice coil 50 can extend through the pair of through slots 121 to electrically connect to the PCB 200 located at the bottom of the base plate 11. The outer diameter of the upper side plate 12 is larger than the outer diameter of the lower side plate 15.

The yoke 20 is substantially oblong bowl-shaped, and includes a circular base wall 21 and a sidewall 22 extending upwardly and perpendicularly from an outer periphery of the base wall 21. The base wall 21 and the sidewall 22 cooperatively define a receiving chamber 23 therebetween. A top end of the sidewall 22 of the yoke 20, namely at an open end of the yoke 20, is located at an inner periphery of the base plate 11 of the frame 10.

The magnet 30 is elliptically cylindrical configuration, and is attached to a top surface of the base wall 21 of the yoke 20. The pole plate 40 is elliptical and laminar, and attached to a top surface of the magnet 30. The magnet 30 and the pole plate 40 are received in the receiving chamber 23 of the yoke 20, and are coaxial with the yoke 20. An outer diameter of the magnet 30 and an outer diameter of the pole plate 40 are smaller than an inner diameter of the yoke 20. Thereby, outer peripheral side surfaces of the magnet 30 and the pole plate 40, and the sidewall 22 of the yoke 20, cooperatively define an annular gap 321 therebetween, for accommodating a bottom end of the voice coil 50 therein. The voice coil 50 is elliptical and hollow. The voice coil 50 surrounds the magnet 30 and the pole plate 40 and is movable up and down in the annular gap 321.

The diaphragm 60 is elliptical, and has a thin cross-section. The diaphragm 60 includes a central area 61 in a center thereof, a joint area 62 at an outer periphery thereof, and a connecting area 63 between the central area 61 and the joint area 62. The central area 61, the joint area 62 and the connecting area 63 are coaxial. The central area 61 includes a dome-shaped central section 611 at a center thereof, and a coil connecting section 612 at an outer periphery of the central section 611. A top side of the voice coil 50 is jointed to a bottom surface of the coil connecting section 612. The connecting area 63 is disposed at an outer periphery of the coil connecting section 612, and is curved upwardly or downwardly to form an annular bulge or concave. The joint area 62 is annular, and disposed at an outer periphery of the connecting area 63.

The case 70 is oblong configuration and covers the diaphragm 60. The case 70 includes a first top wall 71, and a first connecting portion 72 extending outward from an outer periphery of the first top wall 71. The first top wall 71 is annular and planar, and defines a sound outlet 711 on a central area thereof. Sound generated by the micro-speaker 100 is transmitted to the outside of the micro-speaker 100 through the sound outlet 711. The first connecting portion 72 covers the flange 14 of the frame 10.

The PCB 200 is oblong configuration and attached to the bottom of the base plate 11. The PCB 200 has an outer diameter substantially equal to that of the base plate 11 of the frame 10. The PCB 200 includes a second top wall 201, and a second connecting portion 202 extending outward from an outer periphery of the second top wall 201. The second top wall 201 is annular and planar, and defines an opening (not labeled) on a central area thereof. The low side plate 15 of the frame 10 passes throughout the opening. The second connecting portion 202 covers on the bottom of the flange 14 of the frame 10. A pair of first pads 203 is formed on a top surface of the second connecting portion 202 for electrically connecting with the terminals of the voice coil 50. A pair of second pads 204 is formed on the bottom surface of the second connecting portion 202 and electrically connects to the corresponding first pads 203. A pair of conducting point 205 extends from a side of the corresponding second pads and faces to each other. In the present embodiment, the distance between the two second pads 204 is bigger than 0.2 mm. The conducting point 205 is triangular and made of copper. Alternatively, in other embodiments, the conducting point 205 can be any other configuration with a tip and can be made of any other conductive material.

In the present micro-speaker 100, the opposite terminals of the voice coil 50 pass through the pair of slots 121 to electrically connect with the conducting points 205 via the first and second pads 203, 204. Thus, static electricity generated due to vibration of the diaphragm 60 and the voice coil 50 will be activated to discharge from the conductive points 205 by the corona discharge. This avoids static electricity and an oscillating electric current in the voice coil 50 interfering with each other, and thus improves the sound output quality of the micro-speaker 100. In addition, the PCB 200 and the voice coil 50 electrically connecting with the PCB 200 are protected from being burnt out by too much static electricity, whereby the reliability of the micro-speaker 100 improved. Be noted that the printed circuit board of the embodiment may be construed as a board having conductive paths thereon. Therefore, the printed circuit board may be a common printed circuit board, or be a board with conductive elements embedded in isolative material.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker comprising:

a frame;

a case supported on the frame and cooperatively with the frame defining a chamber therebetween;

a diaphragm received in the chamber and attached to the frame;

a yoke received in the chamber;

a magnet received in the chamber and attached on the top of the yoke;

a pole plate received in the chamber and attached to the top of the magnet;

a voice coil attached to a bottom of the diaphragm and surrounding the magnet and the pole plate;

a printed circuit board mounted on the bottom of the frame;

wherein the printed circuit board defines a pair of pads formed on the bottom thereof and electrically connecting with the corresponding terminals of the voice coil to apply electric current to the voice coil, and a pair of conductive points extending from a side of the corresponding pads and each facing to each other, when generated, static electricity will be activated to discharge from the conducting points by the corona discharge.

2. The micro-speaker as claimed in claim 1, wherein the printed circuit board is oblong configuration and has an outer diameter substantially equal to an outer diameter of the frame.

3. The micro-speaker as claimed in claim 1, wherein the conductive point is triangular and made of copper.

4. The micro-speaker as claimed in claim 1, wherein the distance between the pair of the pads is bigger than 0.2 mm.

5. The micro-speaker as claimed in claim 1, wherein the frame is approximately oblong bowl-shaped, and includes a base plate, an upper side plate extending upwardly and perpendicularly from an outer periphery of the base plate, a rectangular flange extending outwardly from an outer side of the upper side plate, and a low side plate extending downwardly and perpendicularly from a bottom portion of the base plate.

6. The micro-speaker as claimed in claim 5, wherein the base and side plates cooperatively define a receiving space therebetween, and the base plate is elliptical for supporting the yoke thereon.

7. The micro-speaker as claimed in claim 6, wherein the upper side plate defines a pair of through slots spanning an entire height thereof and formed adjacent to the flange, the two opposite terminals of the voice coil can extend through the pair of through slots to electrically connect to the printed circuit board located at the bottom of the base plate.

8. The micro-speaker as claimed in claim 7, wherein the case is oblong configuration and covers the diaphragm, the case includes a first top wall and a first connecting portion extending outward from an outer periphery of the first top wall.

9. The micro-speaker as claimed in claim 8, wherein the printed circuit board includes a second top wall, and a second connecting portion extending outward from an outer periphery of the second top wall and covering on the bottom of the flange of the frame, the second top wall is annular and planar, and defines an opening on a central area thereof for being passed through the low side plate.

10. The micro-speaker as claimed in claim 9, wherein the magnet and the pole plate are elliptically cylindrical configuration.

* * * * *